United States Patent [19]

Sable

[11] 4,380,347

[45] Apr. 19, 1983

[54] WELL TOOL

[76] Inventor: Donald E. Sable, 4413 Windsor Pkwy., Dallas, Tex. 75234

[21] Appl. No.: 202,795

[22] Filed: Oct. 31, 1980

[51] Int. Cl.[3] ..... F16L 57/00

[52] U.S. Cl. ..... 285/45; 285/333; 308/4 A

[58] Field of Search ..... 285/45, 333, 334; 308/4 A

[56] References Cited

U.S. PATENT DOCUMENTS

| | | | |
|---|---|---|---|
| 1,396,452 | 11/1921 | Moesmer | 285/45 |
| 2,513,621 | 7/1950 | Boice | 308/4 A |
| 2,546,295 | 3/1951 | Boice | 308/4 A |
| 2,592,854 | 4/1952 | Boice | 308/4 A |
| 3,268,275 | 8/1966 | Laughlin | 308/4 A |
| 3,398,977 | 8/1968 | Yoneda | 285/45 |
| 3,942,824 | 3/1976 | Sable | 285/45 |
| 4,011,918 | 3/1977 | Jurgens | 308/4 A X |

*Primary Examiner*—Thomas F. Callaghan

[57] ABSTRACT

A well tool, such as a drilling pipe string, whose joints are provided with tubular protectors which are restrained against vertical movement on the joints while permitting rotation of the drilling pipe string relative thereto when the protectors engage the internal surfaces of a well bore or of a well casing through which the drilling pipe string extends.

1 Claim, 4 Drawing Figures

WELL TOOL

This invention relates to well tools and more particularly to an elongate well tool having a protector at a connection of two sections of the well tool.

As is described in detail in the U.S. patent to Donald E. Sable, U.S. Pat. No. 3,942,824, issued Mar. 9, 1976, and the references cited by the United States Patent Office during the prosecution of the application on which this patent issued various means have been used to minimize wear of the tool joints connecting sections of a drill pipe string. The string of drill pipe is formed of sections or pipes each having a box-half of a tool joint at its upper end and a pin-half of a tool joint at its lower end with adjacent ends of adjacent drill pipe sections connected by the threading of the pin-half of the upper drill pipe section in the box-half of the lower drill pipe section. In order to provide sufficient mechanical strength at the connections without decreasing the internal diameter of the drill pipe sections the joint halves are enlarged. During drilling operations, the enlarged tool joint halves tend to engage the well casing in the portions of the well bore provided with casing and the earth formation in the portions of the well bore not provided with casing.

The well tool protector disclosed in U.S. Pat. No. 3,942,824 comprises a cylindrical mandrel having resilient internal compression members which are resiliently compressed between the joint half and the mandrel, the protectors being held against longitudinal movement on the joint half by the engagement of an internal flange of the mandrel with external shoulders of the joint halves.

While this protector provides the desired protection, it has certain disadvantages. Since it is disposed about a tool joint it decreases the annulus between the drill pipe string and the casing or the well bore. In addition, as the well bores are being drilled to greater depths, the weight of drill string becomes an important factor.

It is desirable therefore that a protector and tool joint half of a drill pipe be provided which will reduce the weight of the drill pipe and provide protection for the tool joint while not appreciably increasing the external diameter of the drill pipe joint.

Accordingly, it is an object of the invention to provide a new and improved well tool having a tubular protector at the location of connection of two elongate sections of the well tool.

Another object is to provide a well tool, of the type described, wherein the protector is restricted against longitudinal movement relative to the well tool, but permits rotation of the elongate sections relative to the protector.

Still another object is to provide a well tool, of the type described, having two tubular sections having adjacent threadedly connected joint portions, one of the joint portions having a reduced portion on which the tubular protector is telescoped.

A further object is to provide a well tool, of the type described, wherein resilient compression means are provided between the protector and the joint portion on which it is disposed.

Additional objects and advantages of the invention will be readily apparent from the reading of the following description of a well tool constructed in accordance with the invention and reference to the accompanying drawings thereof, wherein.

Figure 1:
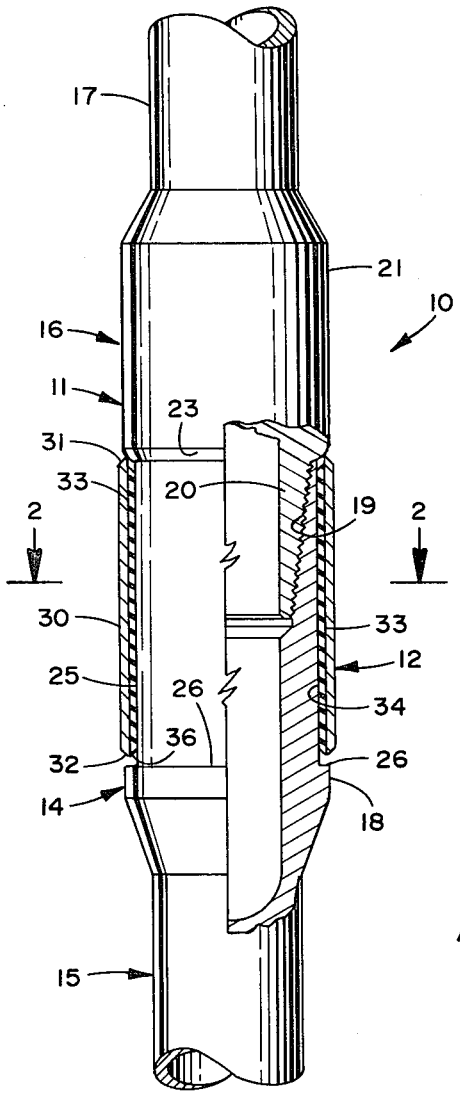
FIG. 1 is a vertical sectional view of a drill pipe joint of the invention.
Figure 2:
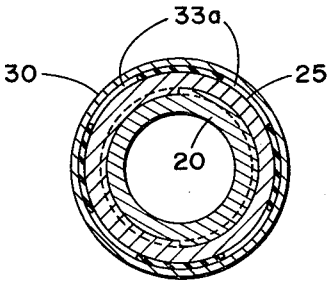
FIG. 2 is a sectional view taken on line 2—2 of FIG. 1.
Figure 3:
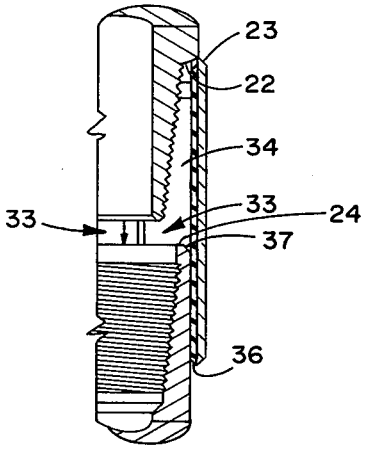
FIG. 3 is a fragmentary sectional view showing the manner in which the pin half of the tool joint forcibly moves the protector onto the box half; and, FIG. 4 is a vertical partly sectional view of a modified form of the well tool.

Referring now to the drawings the well tool 10 embodying the invention includes a tool joint 11 and a tool joint protector 12. The tool joint includes a box-half 14 on the top end of a lower drill pipe section 15 and a pin half 16 on the lower end of the adjacent upper drill pipe section 17.

The box-half 14 of the tool joint includes the externally enlarged top end portion 18 of a drill pipe section, the bore of which at its top portion is enlarged and internally threaded as at 19 to receive the externally reduced threaded end portion 20 of the pin-half 16 at the bottom of the adjacent upper pipe section 17. The pin half of the joint includes the externally enlarged portion 21 which provides an inwardly inclined or bevelled annular surface 23 and a downwardly facing annular shoulder 22 which engages the annular top end surface 24 of the box half.

The enlarged top end portion 18 of the lower drill pipe section has an externally reduced upper end portion 25 extending from the external upwardly facing annular shoulder 26 to the annular top end surface 24.

The protector 12 includes a cylindrical mandrel 30 whose external diameter is somewhat greater than the external equal diameters of the enlarged portions 18 and 21 of drill pipe sections. The internal diameter of the mandrel is greater than the external diameter of the end portion 25, but smaller than the external diameter of the enlarged portion 18 of the lower drill pipe section. As a result, when the protector is in position on the tool joint 11 as illustrated in the drawing, longitudinal movement of the protector on the tool joint is limited by the engagement of its top and bottom annular end surfaces 31 and 32 with the shoulders 22 and 26 of the pin-half and box-half, respectively, of the tool joint.

The mandrel at its inner surface has a plurality of longitudinally extending spaced resilient compression members 33 bonded thereto. The internal surfaces 34 thereof lie in a cylindrical plane which is of a somewhat smaller diameter then the external diameter of the top end portion 25 which they engage. As a result when the protector is on the tool joint, the compression members are compressed between the top end portion 25 and the mandrel 30.

The compression members are provided at the lower ends with upwardly and inwardly extending cam shoulders 36 which are adopted to engage the downwardly and outwardly extending cam shoulder 37 of the box-half of the joint to facilitate telescopic movement of the protector on the box-half.

While only four compression members 33 have been shown for ease and clarity of illustration, in actual practice the compression members are of very smaller width and as many as thirty or more in number.

The protector is installed on the box-half 14 of the tool joint 11, by positioning it over and in longitudinal axial alignment with the reduced end portion 25 of the box-half with the cam shoulders 36 of the compression members 33 engaging the cam shoulder 37 of the box-half while the lower drill pipe section is held in usual fashion against downward movement.

The upper drill pipe section 17 is then lowered toward the lower drill pipe section 15, the threaded portion 20 telescoping into the protector 10. As downward movement of the upper drill pipe section continues, its shoulder 22 engages the top surface 31 of the mandrel 30 and the weight of the upper drill pipe section now forces the protector to telescope downwardly over the reduced top end portion 25 of the box-half. Obviously, the compression members are compressed between the end portion 25 and the mandrel during this telescope movement. The longitudinal spaces 33*a* between adjacent side of adjacent compression members permit lateral resilient deformation or flow of the compression members to permit such telescopic movement.

The drill string joints provided with such protection facilitate drilling operations because as a joint moves toward engagement with an earth formation penetrated by the well bore being drilled, the mandrel 30, since it projects outwardly of the tool joint outer surfaces of the enlarged portions 18 and 21 of the tool joint, will engage the earth formation. Any such contact of any portion of the drill string of course increases the forces resisting rotation of the drill string. Since the tool joint provided with the protector 12, however, may rotate relative to the protector, when the force tending to cause the drill string to rotate relative to the tool protector exceeds the force with which the compressed compression members 33 resist such rotation, the increase in force required to rotate the drill string is much smaller than if the tool joint were not provided with the protector.

The provision of the resilient compression members also reduces shocks to the drill string caused by engagement of the tool joint with earth formations or the well casing.

As a result, the tool joints may be of smaller diameter, thus reducing the weight of the drill pipe string. The force required to rotate the drill string during drilling operation is thus also decreased resulting in saving of energy. Accidental breaking or twisting off of the drilling pipe string at a location where the force resisting rotation of the string due to a contact of a tool joint with the casing or an earth formation is of course prevented since the degree of such force is limited by the compression members. The hardness of the compression members, the degree of their compression and their dimensions are of course so chosen that the force exerted by the compression members resisting rotation of the drill pipe string relative to the protector is of any predetermined desired value.

Figure 4:
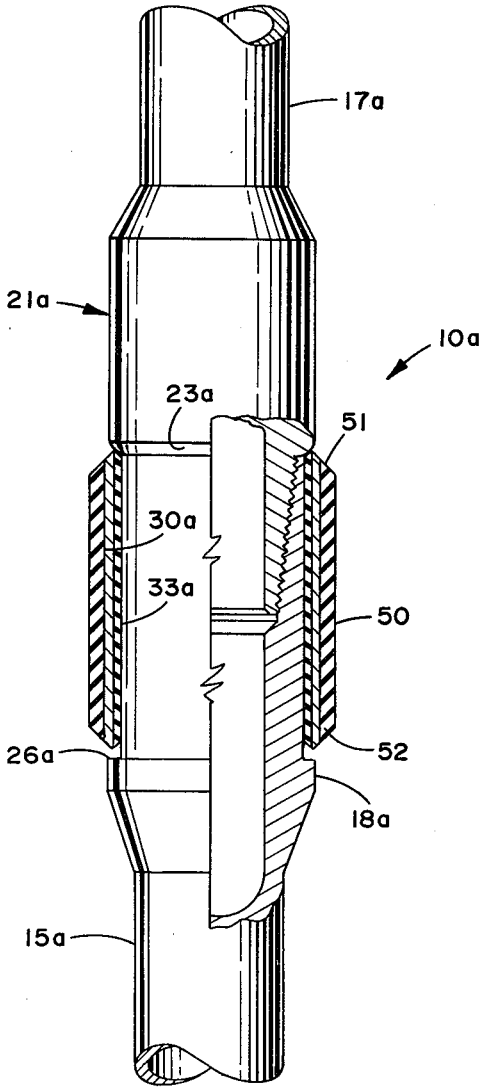

Referring now to FIG. 4 of the drawing, the well tool 10*a* is similar to the well tool 10 and accordingly, its elements have been provided with the same reference numerals to which the suffix "a" has been added as the corresponding elements of well tool 10.

The well tool 10*a* differs from the well tool 10 only in that a resilient tubular body 50 is molded or bonded about the mandrel 30*a*. The body 50 may have convergently outwardly extending annular cam shoulders 51 and 52 to help guide its longitudinal movement past internal obstructions of well casing or earth formations.

The well tool 10*a* may be used along lengths of the drill pipe string wherein it is desired to minimize wear of a well casing. The well tools 10 may be used in lengths of the drill pipe strings rotating in the uncased portions of the well bore. The hardness of the metal of which the mandrel is made may be varied as required by variations in earth formations characteristics, forces to be encountered, and the like.

While the protector has been described and illustrated as located on a reduced portion of the box half, it will be apparent to those skilled in the art that it could be mounted on the pin half in which case the enlarged portion 21 of the pin half would be provided with a reduced portion while the box half would not be reduced as at 25.

The foregoing description of the invention is explanatory only and changes in the detail of the combination illustrated may be made by those skilled in the art within the scope of the appended claims, without departing from the spirit of the invention.

What is claimed as new and desired to be secured by Letters Patent is:

1. A well tool including: a tool joint comprising a pin half on one section of an elongate tubular member having a reduced threaded end portion, and a box half on another elongate tubular member having a threaded bore in which said reduced threaded end portion is disposed, one of said tool joint halves having an externally reduced end portion providing an annular external shoulder, the other of said joint halves having an external annular shoulder, said shoulders facing one another; and a protector longitudinally and rotatably disposed on said reduced end portion of said one of said joint halves, said protector comprising a tubular mandrel having an internal diameter greater than that of said reduced end portion of said one of said joint halves and an external diameter greater than that of said annular shoulder whereby longitudinal movement of said mandrel relative to said joint halves is limited by said shoulders; and a plurality of longitudinally extending resilient compression members circumferentially spaced in said mandrel and secured thereto, said compression members being compressed between said mandrel and said reduced end portion of said one of said joint halves, said compression members permitting rotation of said mandrel relative to said tool joint.

* * * * *